US008152914B2

(12) United States Patent
Schadow et al.

(10) Patent No.: US 8,152,914 B2
(45) Date of Patent: Apr. 10, 2012

(54) PROCESS FOR APPLYING A METAL COATING TO A NON-CONDUCTIVE SUBSTRATE

(75) Inventors: Sigrid Schadow, Teltow (DE); Brigitte Dyrbusch, Berlin (DE); Carl Christian Fels, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 238 days.

(21) Appl. No.: 12/451,191

(22) PCT Filed: Apr. 24, 2008

(86) PCT No.: PCT/EP2008/003345

§ 371 (c)(1), (2), (4) Date: Nov. 12, 2009

(87) PCT Pub. No.: WO2008/135179

PCT Pub. Date: Nov. 13, 2008

(65) Prior Publication Data

US 2010/0119713 A1 May 13, 2010

(30) Foreign Application Priority Data

May 3, 2007 (EP) ..... 07008950

(51) Int. Cl.

| | |
|---|---|
| ***C25D 5/54*** | (2006.01) |
| ***C25D 5/56*** | (2006.01) |
| ***C23C 18/28*** | (2006.01) |
| ***C23C 18/30*** | (2006.01) |
| ***C23C 28/04*** | (2006.01) |

(52) U.S. Cl. ..... 106/1.11; 106/1.05; 106/1.22; 106/1.23; 106/1.25; 106/1.26; 106/1.27; 205/158; 205/159; 205/263; 205/266; 205/267; 205/271; 205/291; 205/296

(58) Field of Classification Search ..... 106/1.05, 106/1.11, 14.44, 1.22, 1.23, 1.25, 1.26, 1.27; 205/158, 159, 263, 266, 267, 271, 291, 296; 427/383.1, 383.3, 383.7

See application file for complete search history.

(56) References Cited

U.S. PATENT DOCUMENTS

| | | | | |
|---|---|---|---|---|
| 3,011,920 | A | 12/1961 | Shipley | |
| 3,682,671 | A | 8/1972 | Zeblisky | |
| 3,984,290 | A | 10/1976 | Kitaev et al. | |
| 4,005,051 | A | 1/1977 | Brunner | |
| 4,919,768 | A | 4/1990 | Bladon | |
| 5,318,726 | A * | 6/1994 | Rossmaier et al. | 510/361 |
| 5,910,340 | A | 6/1999 | Uchida et al. | |
| 6,870,026 | B1 * | 3/2005 | Dean | 528/354 |
| 7,166,688 | B1 | 1/2007 | Dean | |
| 2005/0048420 | A1 | 3/2005 | Wichmann | |
| 2011/0062030 | A1 * | 3/2011 | Lippert et al. | 205/157 |

FOREIGN PATENT DOCUMENTS

| | | | |
|---|---|---|---|
| CA | 2210883 | A1 | 9/1996 |
| EP | 0 298 298 | A2 | 1/1989 |
| EP | 0 320 601 | A2 | 6/1989 |
| EP | 0 456 982 | A1 | 11/1991 |
| EP | 0 538 006 | A1 | 4/1993 |
| EP | 0 616 053 | A1 | 9/1994 |
| EP | 0 913 502 | A1 | 5/1999 |
| EP | 1 306 465 | A2 | 5/2003 |
| RU | 1819556 | A1 * | 6/1993 |
| WO | WO-89/08375 | A1 | 9/1989 |
| WO | WO-96/29452 | A1 | 9/1996 |

* cited by examiner

*Primary Examiner* — Anthony J Green

(74) *Attorney, Agent, or Firm* — Peter F. Corless; Christine C. O'Day; Edwards Wildman Palmer LLP

(57) ABSTRACT

Described is a new process for applying a metal coating to a non-conductive substrate comprising the steps of (a) contacting the substrate with an activator comprising a noble metal/group IVA metal sol to obtain a treated substrate, (b) contacting said treated substrate with a composition comprising a solution of: (i) a Cu(II), Ag, Au or Ni soluble metal salt or mixtures thereof, (ii) 0.05 to 5 mol/l of a group IA metal hydroxide and (iii) a complexing agent for an ion of the metal of said metal salt, wherein an iminosuccinic acid or a derivative thereof is used as said complexing agent.

12 Claims, No Drawings

PROCESS FOR APPLYING A METAL COATING TO A NON-CONDUCTIVE SUBSTRATE

FIELD OF THE DISCLOSURE

The invention relates to a process for applying a metal coating to a non-conductive substrate and to a composition used in this process.

BACKGROUND OF THE INVENTION

Various methods are known of coating non-conductive surfaces. In wet chemical methods, the surfaces to be metallised are, after an appropriate preliminary treatment, either firstly catalysed and then metallised in an electroless manner and thereafter, if necessary, metallised electrolytically, or are directly electrolytically metallised.

Methods according to the first variant with electroless metallisation have, however, proved disadvantageous, as process management of the electroless metallising bath is difficult, treatment of the waste water from this bath is complex and expensive, and the process is lengthy and thus likewise expensive due to the low deposition speed of the metallising bath.

Especially for metal coating of plastic parts, for example for sanitary fittings and for the automobile industry, and of parts which are used as casings for electrical appliances which are screened against electromagnetic radiation, the electroless metallising methods are problematic. In treatment of such moulded parts, generally relatively large volumes of the treatment solutions are carried over from one treatment bath into the next, as these have a shape by means of which the treatment solution is transported out of the baths when the parts are lifted out. As electroless metallising baths normally contain considerable quantities of toxic formaldehyde and complex formers which are only removable with difficulty, in their treatment large quantities of these baths are lost and must be disposed of in a complicated manner.

For this reason a series of metallising methods was developed, by means of which the non-conductive surfaces could be directly coated with metal without electroless metallisation (see, for example, EP 0 298 298 A2, U.S. Pat. No. 4,919,768, EP 0 320 601 A2, U.S. Pat. No. 3,984,290, EP 0 456 982 A1 and WO 89/08375 A1).

In EP 0 616 053 A1 there is disclosed a method for direct metallisation of non-conductive surfaces, in which the surfaces are firstly treated with a cleaner/conditioner solution, thereafter with an activator solution, for example a palladium colloidal solution, stabilised with tin compounds, and are then treated with a solution which contains compounds of a metal which is more noble than tin, as well as an alkali hydroxide and a complex former. Thereafter the surfaces can be treated in a solution containing a reducing agent, and can finally be electrolytically metallised.

WO 96/29452 concerns a process for the selective or partial electrolytic metallisation of surfaces of substrates made from electrically non-conducting materials which for the purpose of the coating process are secured to plastic-coated holding elements. The proposed process involves the following steps: a) preliminary treatment of the surfaces with an etching solution containing chromium (VI) oxide; followed immediately by b) treatment of the surfaces with a colloidal acidic solution of palladium-/tin compounds, care being taken to prevent prior contact with adsorption-promoting solutions; c) treatment of the surfaces with a solution containing a soluble metal compound capable of being reduced by tin (II) compounds, an alkali or alkaline earth metal hydroxide, and a complex forming agent for the metal in a quantity sufficient at least to prevent precipitation of metal hydroxides; d) treatment of the surfaces with an electrolytic metallisation solution.

The processes described in EP 0 616 053 A1 and WO 96/29452 are disadvantageous in that they require the use of a noble metal such as palladium which is a very expensive metal.

Hence, it is the object underlying the present invention to provide a process requiring a reduced amount of a noble metal such as palladium to activate the surface of the non-conductive substrate to be metal-coated.

SUMMARY OF THE DISCLOSURE

This object is achieved by a process for applying a metal coating to a non-conductive substrate comprising the steps of (a) contacting the substrate with an activator comprising a noble metal/group IVA metal sol to obtain a treated substrate, (b) contacting said treated substrate with a composition comprising a solution of:

(i) a Cu(II), Ag, Au or Ni soluble metal salt or mixtures thereof, (ii) 0.05 to 5 mol/l of a group IA metal hydroxide and (iii) a complexing agent for an ion of the metal of said metal salt, wherein iminosuccinic acid or a derivative thereof is used as said complexing agent.

DETAILED DESCRIPTION OF THE INVENTION

It has been surprisingly found that the use of iminosuccinic acid or a derivative thereof makes it possible to substantially reduce the amount of noble metal such as palladium in the activator.

Suitable iminosuccinic acid derivatives for use in the present invention include those having the formula (I) shown below:

(I)

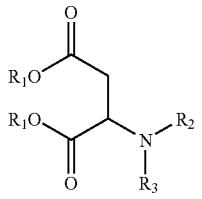

wherein $R_1$ is selected from the group consisting of H, Na, K, $NH_4$, Ca, Mg, Li and Fe, $R_2$ is selected from the group consisting of

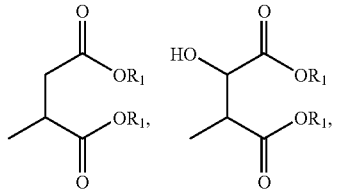

-continued

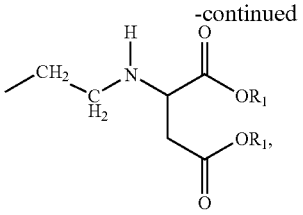

—$CH_2$—$COOR_1$, —$CH_2$—$CH_2$—$COOR_1$, —$CH_2$—$CH_2$—OH, —$CH_2$—CHOH—$CH_3$ and —$CH_2$—CHOH—$CH_2OH$, and $R_3$ is selected from the group consisting of H, —$CH_2$—$COOR_1$, —$CH_2$—$CH_2$—$COOR_1$, —$CH_2$—$CH_2$—OH, —$CH_2$—CHOH—$CH_3$ and —$CH_2$—CHOH—$CH_2OH$.

The above mentioned compounds are described in DE 198 50 359 A1. WO 00/26398 describes a method of producing compounds of formula (I) and their mixtures on the basis of carbohydrates by fermentation in the presence of microorganisms.

Preferably, the iminosuccinic acid derivative is the iminosuccinic acid sodium salt having the following structural formula:

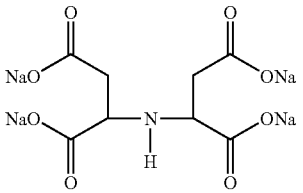

The non-conductive substrates to be coated according to the process of the present invention are not particularly limited. These substrates include plastic parts which are intensely structured, such for example as combs or articles designed with a substantial extension in the third dimension, e.g. coffee pots, telephone handsets, water pipe fittings, etc. However, also other non-conductive substrates such as ceramic substrates or other metal oxide non-conductive substrates can be coated according to the present invention. In addition, small surfaces such as through-hole walls of printed circuit boards can be coated.

The substrate may then optionally be micro-etched with a chemical etchant, where the substrate comprises a non-conductive material having a metal layer on it such as a copper-clad substrate which is employed in the manufacture of circuit boards. An example of such a chemical etchant includes standard etching agents containing a mixture of chromic and sulphuric acid. The microetching step is employed in order to prepare the metal layer such as the copper layer portion of the substrate for subsequent electroplating. Acid dips and water rinses may be included after etching.

Prior to treating the substrate with an activator, it may be immersed in a commercial pre-dip containing NaCl, $SnCl_2$ and HCl, the pH of which is below about 0.5.

The substrate then treated with an activator comprising a noble metal/Group IVA metal sol. Noble metals comprise Ag or Au or Group VIII noble metals including Ru, Rh, Pd, Os, Ir, Pt, or various mixtures of such noble metals. The preferred noble metals are the Group VIII noble metals and especially a metal comprising palladium.

The activator of the present invention is prepared in such a fashion so that there is excess Group IVA metal compound reducing agent present, i.e., a stoichiometric excess of reducing agent (e.g., divalent tin) compared to the noble metal compound (e.g., divalent Pd) from which the activator is made. In this way the activator such as the Pd/Sn sol has residual divalent Sn that can function as a reducing agent.

The Group IVA metals that may be employed include, for example, Ge, Sn and Pb, or mixtures thereof. Sn being preferred.

The activator preferably will contain a stoichiometric excess of the Group IVA metal as compared to the noble metal. The Group IVA metal is substantially in its lowest oxidation state so that it will be available to reduce the more noble metal salts that are employed in forming the activator. Because it is also employed in a stoichiometric excess based on the salts of the noble metal that are employed to form the activator, the excess of the Group IVA metal in combination with the activator will also be substantially in its lowest oxidation state. The activator thus prepared with the excess of the Group IVA metal in its lowest oxidation state will also be available to reduce the Group IB or other more noble metal salts that are subsequently brought into contact with the activator, such as the salts of copper as described herein. The Group IVA metal is preferably employed as a salt, such as a halide and especially a chloride, but in any event, will be present in an amount so that the molar ratio of the Group IVA metal to the noble metal of the activator is from 4:1 to 95:1, especially 10:1 to 55:1 and preferably from 15:1 to 50:1. Some specific Group IVA metal salts that may be used in this regard comprise $PbCl_2$, $SnCl_2$ or a mixture of $GeCl_2$ and $GeCl_4$ dissolved in dilute hydrochloric acid. The preferred Group IVA metal comprises tin and especially tin in the form of stannous chloride.

The preparation of the activator is conventional and is disclosed in U.S. Pat. No. 3,011,920 and U.S. Pat. No. 3,682,671.

The treated substrate, after the activator solution has been applied, is rinsed and then treated with the above mentioned composition comprising the Cu(II), Ag, Au or Ni soluble metal salt, the group IA metal hydroxide and the iminosuccinic acid (derivative) as a complexing agent for the ions of the metal of the aforementioned metal salts, comprising $Ag^+$, $Ag^{2+}$, $Au^+$, $Au^{2+}$ and $Ni^{2+}$ salts. Preferably, the metal salt is a Cu(II) salt.

Anywhere from 0.0002 to 0.2 mols/l and especially from 0.004 to 0.01 mols/l of the said metal salt may be employed in the bath where the solvent preferably comprises water.

The bath includes a Group IA metal hydroxide in an amount from 0.05 to 5 mol/l, preferably 1 to 3 mol/l and most preferred 1.5 to 2 mol/l. The Group IA metals in this regard comprise Li, Na, K, Rb, Cs or mixtures thereof, especially Li, Na, K and mixtures thereof and preferably a metal comprising Li.

The composition used in the process for applying a metal coating to a non-conductive substrate further includes iminosuccinic acid or salt thereof or a derivative thereof according to formula (I) above as a complexing agent.

The iminosuccinic acid sodium salt can form pentacoordinated complexes. The complex is formed via the nitrogen atom and all four carboxylic groups. Some complex formation constants for various metal ions are shown in the table below:

| Metal ions | $Mg^{2+}$ | $Ca^{2+}$ | $Mn^{2+}$ | $Fe^{2+}$ | $Fe^{3+}$ | $Cu^{2+}$ | $Ag^{+}$ | $Zn^{2+}$ | $Ni^{2+}$ | $Co^{2+}$ |
|---|---|---|---|---|---|---|---|---|---|---|
| Log K | 6.1 | 5.2 | 7.7 | 8.2 | 15.2 | 13.1 | 3.9 | 10.8 | 12.2 | 10.5 |

The complexing agent is employed in an amount sufficient for the bath to form a thin, dense metal-rich catalytic film on the substrate with sufficient electrical conductivity for subsequent electroplating and at the same time produce relatively clean metal surfaces. In general, the complexing agent is used in an amount of 0.005 to 1 mol/l, preferably 0.01 to 0.3 mol/l and most preferably 0.03 to 0.15 mol/l.

In addition to the iminosuccinic acid or iminosuccinic acid derivative complexing agent further complexing agents may be used. These further complexing agents are used in general in an amount of 0.05 to 1.0 mol/l and preferably 0.2 to 0.5 mol/l. Suitable additional complexing agents include complexing agents selected from the group consisting of acetate, acetylacetone, citric acid, 1,2-diaminocyclohexane-N,N,N',N'-tetraacetic acid, dimethylglyoxime (50% dioxane), 2,2'-dipyridyl, ethanolamine, ethylenediamine, ethylenediamine N,N,N',N'-tetraacetic acid, glycine, N'-(2-hydroxyethyl)ethylenediamine-N,N,N'-triacetic acid, 8-hydroxy-2-methylquinoline (50% dioxane), 8-hydroxyquinoline-5-sulfonic acid, lactic acid, nitrilotriacetic acid, 1-nitroso-2-naphthol (75% dioxane), oxalate, 1,10-phenanthroline, phthalic acid, piperidine, propylene-1,2-diamine, pyridine, pyridine-2,6-dicarboxylic acid, 1-(2-pyridylazo)-2-naphthol (PAN), 4-(2-pyridylazo)resorcinal (PAR), pyrocatechol-3,5-disulfonate, 8-quinolinol, salicyclic acid, succinic acid, 5-sulfosalicyclic acid, tartaric acid, thioglycolic acid, thiourea, triethanolamine, triethylenetetramine (trien), 1,1,1-trifluoro-3-2'-thenoylacetone (TTA).

The preferred additional complexing agent for copper ions is an alkanolamine comprising for example monoethanolamine. Alkanolamines in addition to monoethanolamine that may be employed in this regard include the following lower alkanolamines: diethanolamine, triethanolamine, monoisopropanolamine, diisopropanolamine, triisopropanolamine, mono-sec-butanolamine, di-sec-butanolamine, 2-amino-2-methyl-1-propanediol, 2-amino-2-ethyl-1,3-propanediol, 2-dimethylamino-2-methyl-1-propanol, tris(hydroxymethyl) aminomethane, and various mixtures of the alkanolamines.

Other weak complexing agents can be used such as other amines, including aliphatic and cyclic, e.g., aromatic amines having up to 10 carbon atoms all of which are described in Kirk-Othmer, Encyclopedia of Chemical Technology under "Amines". Additionally, mono and poly carboxylic acids having up to 8 carbon atoms and their salts can be used and include amino acids. These acids are also defined in Kirk-Othmer, Id. under "Carboxylic Acids" and "Amino Acids".

The preferred acids in this regard include gluconic acid, lactic acid, acetic acid and tartaric acid.

The composition for use in the process according to the present invention may preferably be obtained from a kit-of-parts, said kit-of-parts comprising composition (A) and (B) wherein composition (A) comprises:

(A1) said iminosuccinic acid or a derivative thereof, (A2) said soluble metal salt and wherein composition (B) comprises:

(B1) said group IA metal hydroxide.

The use of two components (A) and (B) is advantageous in that component (A) comprises the essential compounds for use in the process according to the present invention, whereas component (B) is an alkaline solution adjusting the pH of the final composition. The use of such a separate alkaline solution makes it easier to control the alkalinity of the bath under operating conditions.

The various anions of the above mentioned water-soluble metal salt include inorganic acid anions or mixtures thereof such as the halogen anions, i.e., $F^-$, $Cl^-$, $Br^-$ or $I^-$, $Cl^-$ being especially preferred, sulfate or carbonate anions, lower molecular weight organic acid anions such as formate or acetate anions or salicylate anions and the like. Additionally, mixtures of the foregoing anions can be employed as well as salt-like anions such as $CuCl_2 2KCl.2H_2O$, $CuCl_2 2NaCl.2H_2O$ and the various art known equivalents thereof.

As mentioned above, the use of iminosuccinic acid or a derivative thereof makes it possible to substantially reduce the amount of noble metal such as palladium in the activator.

According to the present invention, the activator comprises at least 10 mg/l of palladium as noble metal, preferably 30-50 mg/l.

According to the prior art processes, such as described in EP-A-0 538 006 or EP-A-0 913 502, the activator requires a much higher concentration in the range of at least 200 mg/l, e.g. 250 mg/l palladium.

After contacting with the activator, the substrates are treated with the composition comprising a solution of the Cu(II), Ag, Au or Ni soluble metal salts or mixtures thereof, the group IA metal hydroxide and the iminosuccinic acid complexing agent, for example, about 10 minutes with the temperature above 60° C. Bath temperature may vary from 49° C. to 82° C. Treatment time ranges from 4 to 12 minutes or more which is typical for production purposes, however, may vary out of this range depending on the temperature and condition of the bath. The time used is actually the time necessary to provide the best metal coverage for the formation of the conductive film or to provide minimum required coverage. The conductive film is then electrolytically coated by methods well known in the art.

Subsequent electroplating is best achieved if the coating is microetched in an acidic oxidising medium so that the adhesion and morphology of the electrolytically applied metal coating (e.g. copper) is optimised. Microetching is effected by an acidic oxidising agent which is conventional in the art, however, it has been found that even short exposures (e.g. about one-half minute) to the microetch solution causes a loss in conductivity and if microetching is carried out over a period of time for about two minutes the coating loses substantially all of its conductivity which indicates it is most likely entirely removed from the substrate.

Accordingly, after the substrate has been treated with the copper bath, for example, it is then preferably rinsed with water and subjected to a neutralisation and reducing bath to eliminate this problem. The neutralisation and reducing bath neutralises the residual alkali on the treated surfaces and also improves the resistance of the conductive film to oxidising chemical micro-etchants.

The neutralisation and reducing steps may be conducted separately, i.e., in separate steps employing a first acid neutralisation bath and a second reducing bath.

Reducing agents that may be employed in this regard are generally disclosed in U.S. Pat. No. 4,005,051 and EP-A-0 616 053.

The treated substrate may then be coated electrolytically with a further or a final metal coating. In other words, the application of the composition as described above to the substrates as defined herein comprises the first step (in a two-step process) for the application of a metal coating to a non-metallic substrate. In this first step, a coating is obtained on the surface of the substrate which significantly lowers the resistivity of the substrate as compared to the conductivity of the substrate prior to the application of the composition according to the present invention. Thus, the present invention is directed to a two-step process wherein the conductivity is increased initially by applying a very thin metal coating haying a resistivity in the range of about 0.04 to 12 kΩ/cm and especially 0.8 to 6 kΩ/cm.

The present invention is further illustrated by the following examples.

Example 1

Two compositions (A) and (B) were prepared as shown below:

Composition (A):

(A1) according to Table 1 below, (A2) about 4.0% by weight $CuSO_4.5H_2O$, (A3) according to Table 1 below, (A4) optionally about 0.01% by weight of a tenside, the remainder being water.

Composition (B):

(B1) 6.0% by weight sodium hydroxide, (B2) 9.0% by weight lithium hydroxide, the remainder being water.

The pH of composition (A) was 4.1 and its density 1.2053 g/cm$^3$. The pH of composition (B) was 13 and its density 1.12 g/cm$^3$.

90 ml/l of composition (A) and 300 ml/l of composition (B) were mixed to obtain a bath comprising the above mentioned components and ingredients.

In total, four baths were prepared comprising the amounts of complexing agents as shown in Table 1 below.

Plates made of ABS (Novodur P2MC) were treated with an etching solution containing chrome (VI) oxide for 10 minutes at a temperature of 70° C. After a rinsing treatment, chrome (VI) compounds adhering to the substrate surfaces were reduced to chrome (III) compounds by treating the substrate with a reducing agent for one minute at room temperature.

After a further rinsing treatment, the substrate was treated in a solution for three minutes at 40° C., the solution being composed as follows: Activator: Colloidal solution containing 40 mg/l palladium as palladium chloride (much less than conventionally used: 200 mg/l Pd), 35 g/l stannous chloride (18.5 g/l Sn) and 350 ml/l hydrochloric acid with a pH of 1 or less for 4 minutes.

After the activator treatment, the substrate was again rinsed.

After the rinsing treatment, the substrate was immersed into the bath obtained from compositions (A) and (B) described above comprising the complexing agent in the amounts described in Table 1 below. Table 1 also lists the results of measurements relating to the amount of palladium, tin and copper adsorbed onto the surface of the substrate depending upon the amount of complexing agent used.

The experiments further showed that the use of the iminosuccinic acid complexing agent made it possible to obtain fully metal-coated HBS plates at the palladium concentrations mentioned above.

Further, a comparison between the solutions obtained by removing the metal coatings from the ABS surfaces shows that the surface that has been treated with the iminosuccinic acid complexing agent has a significantly higher copper concentration at a reduced palladium concentration in the activator as well as a lower tin concentration.

Finally, a comparison between compositions with and without iminosuccinic acid complexing agent added shows that those substrate surfaces which have not been treated with the complexing agent have less copper so that a complete coating is not obtained.

The results obtained in Example 1 are summarised in Table 1 below.

TABLE 1

Results of adsorption measurements on surfaces obtained with activator AKI (40 mg/l palladium)

| | Bath | iminosuccinic acid sodium salt {g/l} | Pd {mg/m$^2$} | Sn {mg/m$^2$} | Cu {mg/m$^2$} |
|---|---|---|---|---|---|
| 1 | Contains 0.30 mol/l sodium gluconate | — | 31.11 | 11.1 | 12.00 |
| 2 | Contains 0.18 mol/l sodium gluconate | 40 (0.12 mol/l) | 28.25 | 8.73 | 15.66 |
| 3 | Contains 0.30 mol/l potassium sodium tartrate | — | 30.31 | 8.57 | 4.71 |
| 4 | Contains 0.18 mol/l potassium sodium tartrate | 40 (0.12 mol/l) | 30.16 | 6.68 | 7.2 |

It is apparent from the experimental results described above that the use of the iminosuccinic acid complexing agent results in a significant higher deposition of copper metal on the substrate surface in the Cu-Link step. In this experiment the overall molar content of complexing agent is kept constant to better compare the results. The metallic copper is deposited by a redox reaction in exchange of Sn:

$$Cu^{2+}+Sn(0)_{absorbed\ on\ the\ substrate\ surface} \rightarrow Cu(0)_{absorbed\ on\ the\ substrate\ surface}+Sn^{2+}$$

The oxidised $Sn^{2+}$ ions are dissolved in the solution. Therefore, a increase deposition of Cu(0) results in a decreased amount of absorbed Sn(0), which also becomes apparent from Table 1.

The process involving the use of this complexing agent can be carried out at a concentration as low as 40 to 50 mg/l of Pd in the activator. According to the prior art processes, a concentration of at least 150 mg/l Pd in the activator is required.

The solution comprising the iminosuccinic acid complexing agent can be prepared more easily than the prior art complexing solutions and, finally, their long-term stability in respect of carbonate formation is increased.

The higher amount of metallic Cu (0) absorbed on the substrate surface results in an excellent final metal coating deposited thereon. A treatment using baths 1 and 3 shown in Table 1 in contrast does not result in a completely metallised surface of the non-conductive surface.

Example 2

The following experiment was performed to show the superior metallisation results:

The substrates treated with the baths listed in Table 1 were washed with water and then subjected to a subsequent copper electroplating step. A commercially available copper electroplating bath Cupracid® HT (Atotech Deutschland GmbH) was used, which contains 250 g/l copper sulfate, 50 g/l sulphuric acid, 50 ppm chloride ions and a brightening agent.

The electroplating operation was performed at a plating solution temperature of 25° C. and a current density of 3 $A/dm^2$ for 15 min.

Metallisation Result:

Bath 1: Poor: Incomplete coverage of the surface with copper

Bath 2: Good: Complete coverage of the surface with copper

Bath 3: Poor: Incomplete coverage of the surface with copper

Bath 4: Good: Complete coverage of the surface with copper

The invention claimed is:

1. A process for applying a metal coating to a non-conductive substrate comprising the steps of (a) contacting the substrate with an activator comprising a noble metal/group IVA metal sol to obtain a treated substrate, (b) contacting said treated substrate with a composition comprising a solution of:

(i) a Cu(II), Ag, Au or Ni soluble metal salt or mixtures thereof, (ii) 0.05 to 5 mol/l of a group IA metal hydroxide and (iii) a complexing agent for an ion of the metal of said metal salt, characterised in that iminosuccinic acid or a derivative thereof is used as said complexing agent.

2. The process according to claim 1 wherein the composition further comprises a second complexing agent in addition to the iminosuccinic acid or its derivative.

3. The process according to claim 1 wherein the complexing agent is used in an amount of 0.005 to 1 mol/l.

4. The process according to claim 2 wherein the second complexing agent is used in an amount of 0.05 to 1.0 mol/l.

5. The process according to claim 4 wherein the second complexing agent is used in an amount of 0.2 to 0.5 mol/l.

6. The process according to claim 5 wherein the second complexing agent is selected from the group consisting of gluconic acid, lactic acid, acetic acid and tartaric acid and salts thereof.

7. The process of claim 1 wherein the composition is obtained from a kit-of-parts, said kit-of-parts comprising composition (A) and (B) wherein composition (A) comprises:

(A1) said iminosuccinic acid or a derivative thereof, (A2) said soluble metal salt and wherein composition (B) comprises:

(B1) said group IA metal hydroxide.

8. A composition for use in a process for applying a metal coating to a non-conductive substrate comprising:

(i) a Cu(II), Ag, Au or Ni soluble metal salt or mixtures thereof, (ii) iminosuccinic acid or a derivative thereof, and (iii) 0.05 to 5 mol/l of a group IA metal hydroxide.

9. The composition according to claim 8 wherein the iminosuccinic acid derivative has the formula (I):

(I)

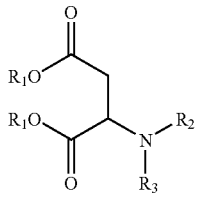

wherein $R_1$ is selected from the group consisting of H, Na, K, $NH_4$, Ca, Mg, Li and Fe, $R_2$ is selected from the group consisting of

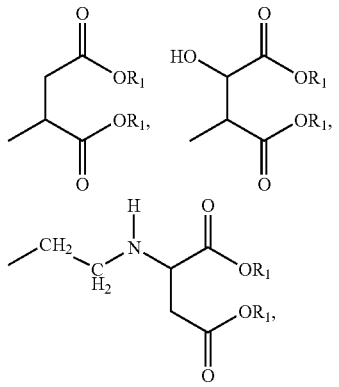

$—CH_2—COOR_1$, $—CH_2—CH_2—COOR_1$, $—CH_2—CH_2—OH$, $—CH_2—CHOH—CH_3$ and $—CH_2—CHOH—CH_2OH$, and $R_3$ is selected from the group consisting of H, $—CH_2—COOR_1$, $—CH_2—CH_2—COOR_1$, $—CH_2—CH_2—OH$, $—CH_2—CHOH—CH_3$ and $—CH_2—CHOH—CH_2OH$.

10. The composition according to claim 8 further comprising a second complexing agent selected from the group consisting of acetate, acetylacetone, citric acid, 1,2-diaminocyclohexane-N,N,N',N'-tetraacetic acid, dimethylglyoxime (50% dioxane), 2,2'-dipyridyl, ethanolamine, ethylenediamine, ethylenediamine N,N,N',N'-tetraacetic acid, glycine, N'-(2-hydroxyethyl)ethylenediamine-N,N,N'-triacetic acid, 8-hydroxy-2-methylquinoline (50% dioxane), 8-hydroxyquinoline-5-sulfonic acid, lactic acid, nitrilotriacetic acid, 1-nitroso-2-naphthol (75% dioxane), oxalate, 1,10-phenanthroline, phthalic acid, piperidine, propylene-1,2-diamine, pyridine, pyridine-2,6-dicarboxylic acid, 1-(2-pyridylazo)-2-naphthol (PAN), 4-(2-pyridylazo)resorcinal (PAR), pyrocatechol-3,5-disulfonate, 8-quinolinol, salicyclic acid, succinic acid, 5-sulfosalicyclic acid, tartaric acid, thioglycolic acid, thiourea, triethanolamine, triethylenetetramine (trien), and 1,1,1-trifluoro-3-2'-thenoylacetone (TTA) in an amount of 0.05 to 1.0 mol/l.

11. The composition according to claim 10 comprising the second complexing agent in an amount of 0.2 to 0.5 mol/l.

12. The composition according to claim 11 wherein the second complexing agent is selected from the group consisting of gluconic acid, lactic acid, acetic acid and tartaric acid and salts thereof.

* * * * *